US006634153B1

(12) United States Patent
Peterson

(10) Patent No.: US 6,634,153 B1
(45) Date of Patent: Oct. 21, 2003

(54) SPECIAL MOMENT TRUSS FRAME

(75) Inventor: Gilbert A. Peterson, Citrus Heights, CA (US)

(73) Assignee: JD2, Inc., Auburn, CA (US)

( * ) Notice: Subject to any disclaimer, the term of this patent is extended or adjusted under 35 U.S.C. 154(b) by 0 days.

(21) Appl. No.: 09/378,540

(22) Filed: Aug. 20, 1999

Related U.S. Application Data

(60) Provisional application No. 60/098,530, filed on Aug. 31, 1998.

(51) Int. Cl.[7] ..... E04C 3/02
(52) U.S. Cl. ..... 52/695
(58) Field of Search ..... 52/695, 693, 692, 52/690, 697, 696, 167.3

(56) References Cited

U.S. PATENT DOCUMENTS 114,039 A * 4/1871 Pratt ..... 52/695 X
1,638,636 A * 8/1927 Lachman ..... 52/695 X
1,901,800 A * 3/1933 Bushey ..... 52/695 X
2,392,674 A * 1/1946 Lachman et al. ..... 52/695 X
2,514,607 A * 7/1950 McLean ..... 52/695 X
2,860,743 A * 11/1958 Cliff ..... 52/695 X
3,400,509 A * 9/1968 Setzer ..... 52/694
4,476,662 A * 10/1984 Fisher ..... 52/693
4,621,475 A * 11/1986 McClain ..... 52/693

* cited by examiner

*Primary Examiner*—David M. Purol
(74) *Attorney, Agent, or Firm*—Mark C. Jacobs

(57) ABSTRACT

A truss for use in building construction having a center portion adapted to "go plastic" during a seismic event, and two outer portions at opposite ends, which remain inelastic during such event. The center portion features spaced opposed upper and lower C-channels connected to interposed spaced gussets, which gussets are connected by both vertical angle members and crossed bars. The crossed bars are also connected at their midpoints to a connection plate.

16 Claims, 4 Drawing Sheets

75
8
8
14
14
13
13
9
9
10
10
12
12
11
11
75

73
77
76
75

30
24
12T
16
20

77
71
16
14

36
18
14
20

28
32
30

20
36
77

36
76
75

SPECIAL MOMENT TRUSS FRAME

RELATION TO OTHER APPLICATIONS

This application claims priority from the co-pending provisional application of Gilbert A. Peterson, Ser. No. 60/098,530 filed Aug. 31, 1998.

FIELD OF THE INVENTION

This invention pertains to open web type trusses used in the construction of earthquake resistant buildings.

BACKGROUND OF THE INVENTION

The special moment truss frame of this invention is seen to be a replacement for the wide-flange steel beams currently utilized in moment resisting frame construction techniques. This invention arose, after a University of Michigan study that resulted in a study of a draft guide for designing special moment—resisting truss frames was released. This study outlined the problems to be overcome, and the inventor of this application has found one means to solve those problems.

More specifically, the structural engineering world has been shifting to what is known as "performance based design" wherein the energy of a seismic event is absorbed by the structure, such that a certain amount of deformation of the structure transpires as a result of the seismic event, but the superstructure while undergoing deformation and deflection, survives the seismic event such that the building remains standing, subsequent to the seismic event. Then after things calm down, replacement components can be put into place as may be determined to be structurally beneficial, while the building is being utilized. The invention of this application is based upon the concepts embodied in performance based design.

This is a totally different thought process from the previous approach, of creating a building structure to limit the deformation, i.e., stand tall and erect and not be influenced by the seismic event. Performance based design operates on the premise that it's OK to deform and deflect, so long as the building does not fall. The truss of this invention employs this new approach in its engineering.

In today's cost competitive world, cost savings over prior art truss designs were desired. Therefore during the development stage, means were looked at to eliminate plates and welded connections wherever possible to achieve these cost savings.

Bearing all of this in mind, and being knowledgeable of the seismic event criteria to be included in the design of a new truss, that would permit a certain amount of deformation, yet would permit the building to continue to stand after a seismic event, the truss of the invention came to be.

It is one object of this invention to provide a new type of truss.

It is a second object to provide a new truss that is particularly applicable to utilization in Zone 4, ie. highly susceptible seismic geographic areas.

It is a third object to provide a truss which when utilized can shorten construction time, and reduce the cost of construction of the building.

It is a forth object to provide a construction technique that eliminates many welding steps and the associated inspection efforts related thereto.

Other objects of the invention will in part be obvious and will in part appear hereinafter.

The invention accordingly comprises the device possessing the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

SUMMARY OF THE INVENTION

A special moment—resisting truss frame is disclosed which can be bolted on both of its ends to vertical columns. The truss frame has two different parts; a center part which is able to achieve a plastic state while the outer portions on opposite ends thereof, remain in the inelastic range during the course of a seismic event. The truss can be bolted into place to achieve lower costs and time savings. The center portion of the truss comprises a series of X shaped bars connected to corner gussets, which gussets are disposed between opposed spaced top and bottom "C" channel members in an open web system. The outer portions of the truss are of the more conventional wide flange and angle members design.

DESCRIPTION OF THE PREFERRED EMBODIMENT

Figure 1:
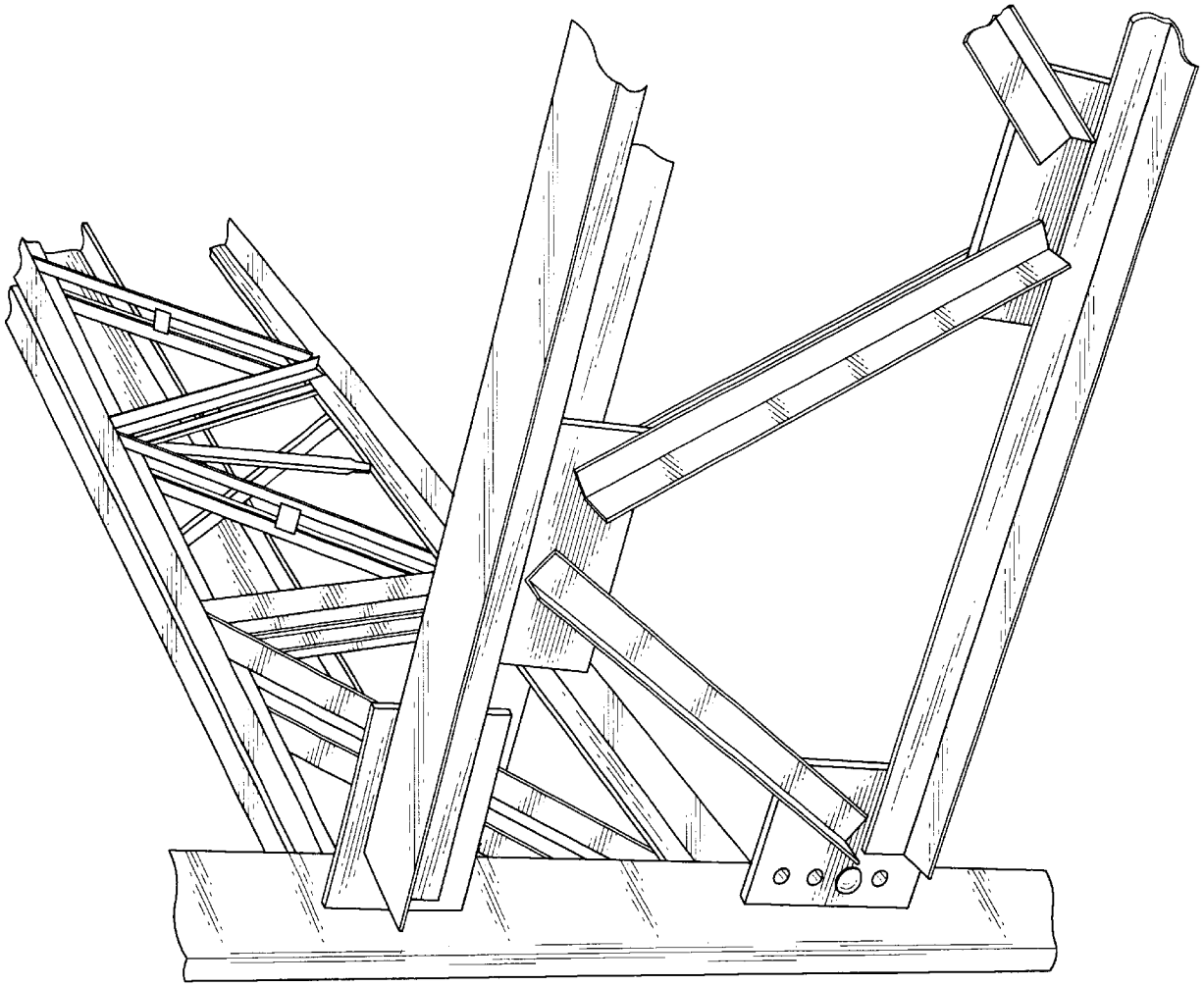
Fig. 1 (Prior Art)
FIG. 1 is a bottom perspective view of a standard open web truss attached to a column. (Prior Art)

FIG. 1 depicts the conventional metal framing of the prior art used in the construction of the skeleton of a building.

Figure 2:
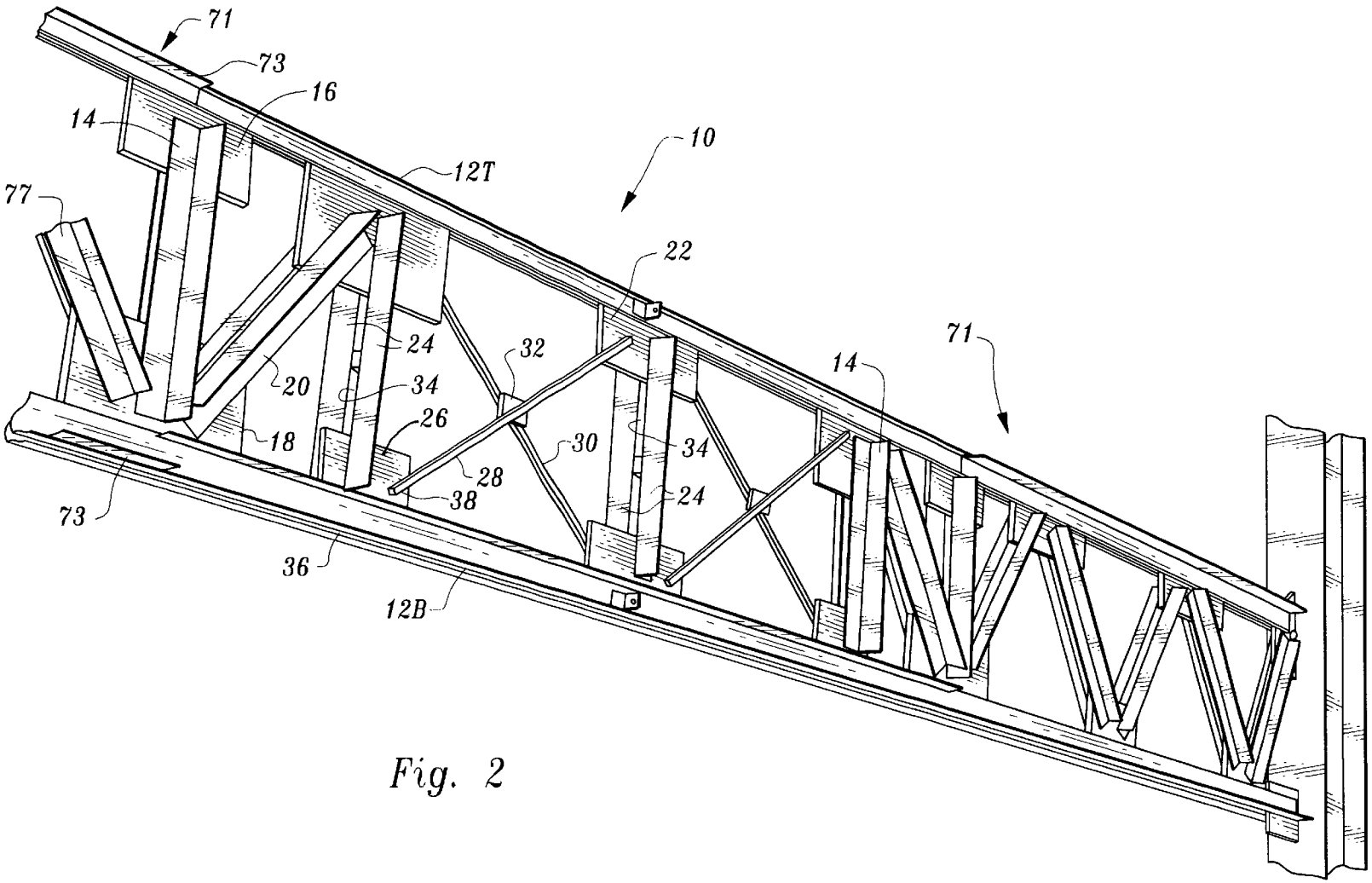
FIG. 2 shows the special moment truss frame of this invention interposed between two standard open web truss units.
Figure 3:
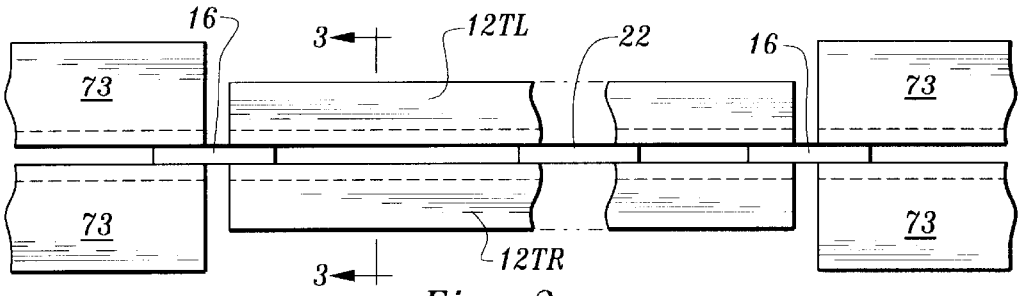
FIG. 3 is a top plan view of the combined standard web frame and the new truss of this invention interposed.
Figure 4:
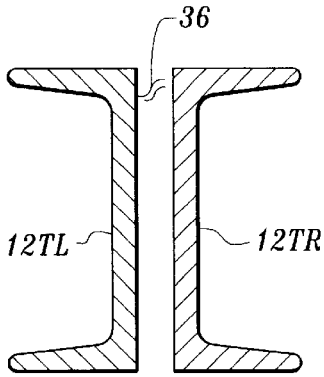
FIG. 4 is a close-up elevational view of one element utilized in this invention, taken along the line 3—3.

The truss of this invention on the other hand is seen in FIGS. 2 and 3 and one key element is seen in FIG. 4.

The top and bottom members of the truss are a pair of opposed and spaced C-channels. See FIG. 4, which is an end view of the pair of channels. The channels are designated 12TL and 12TR for top left and right and 12BL and 12BR for bottom left and right. See FIG. 3.

The reader is now directed to FIG. 2. Here, gusset 14 at the upper terminals, and gusset 22 along the interior and gusset 18 at the lower terminals and 26 at the interior are seen to be welded between the opposed C-channels. Vertical angle members 24 are welded to the gussets to span between gussets 16, 18 and to span between gussets 22, 26. The gap 34 between the channels is equivalent to the thickness of the gussets. Gap 36 is the space between the opposed C-channels 12L, 12R at both the top and bottom of the truss.

Crossed square bars 28 and 30 are welded (38) to diagonally opposed gussets, per FIG. 2. One bar goes to the obverse side of the two gussets to which it is connected and one bar goes to the reverse side of its gusset. The bars are joined at the connector plate 32. It is believed that non-square shaped bars can also be employed as bars, 28, 30.

While two sections having these X bars are shown in the Figures, the number of segments in a truss is theoretically unlimited. Often three, four or even more sections can be linearly aligned.

Figure 6:
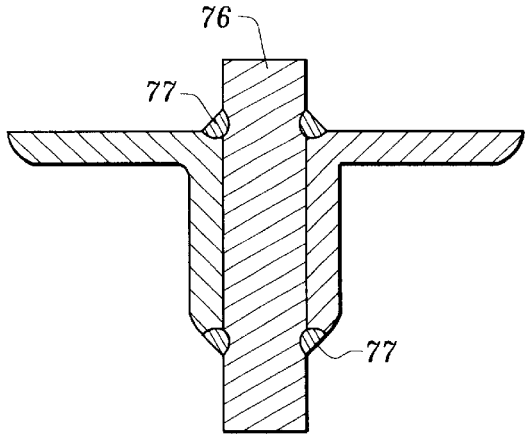
FIG. 6 is a sectional view taken along the line D—D of FIG. 5
Figure 5:
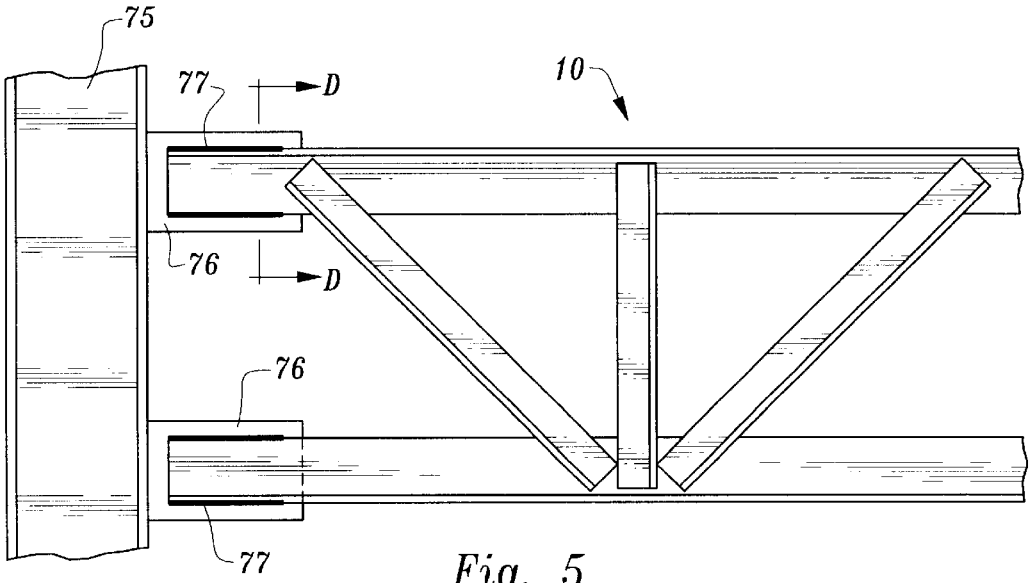
FIG. 5 illustrates the connection of the Special Moment Truss Frame of this invention to a typical wide flange vertical column employed in the framing of a large building.

Reference is now made to FIG. 5. Here the inventive apparatus 10 is seen to be attached to a typical wide flange column 75, by a single pass filet weld, 77 to flange 76 which requires no preheat or ultrasonic testing. Such connections, especially when contrasted to those that require a doubler plate can reduce labor cost for attachment by as much as 90%. See also FIG. 6 the sectional view taken along line D—D of FIG. 5 which illustrates the weld.

Figures 7, 8, 9, 10, 11, 12, 13, 14:
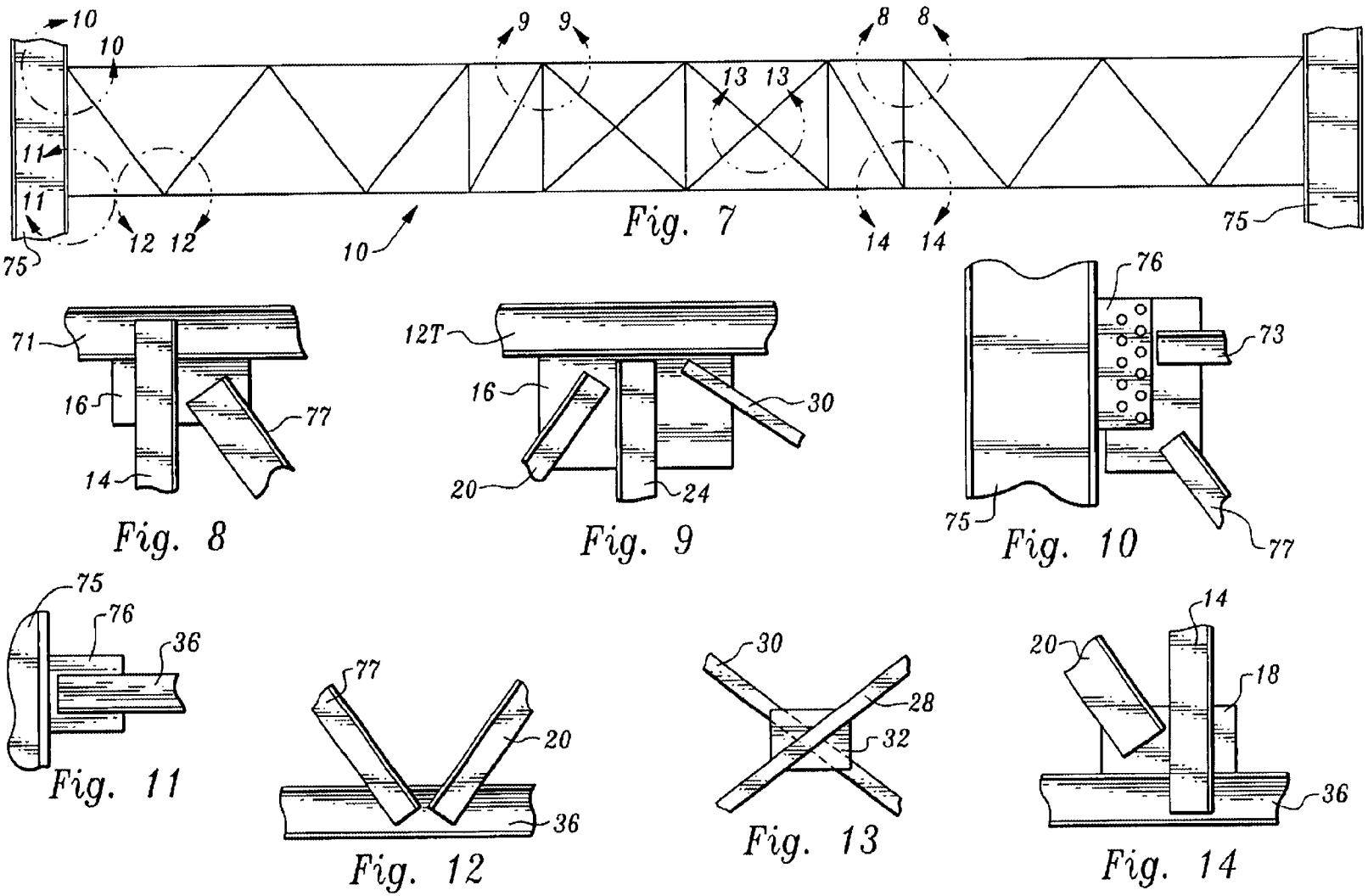
FIG. 7 is a typical architectural rendering of a truss according to this invention, spanned between two vertical columns.
FIGS. 10 and 11 are close-up diagrammatical views illustrating the type of tie-in or connection to be made between the truss of this invention and the spaced columns at opposite ends.
FIGS. 8, 9, 12, 13, and 14 are close-up diagrammatic views of the junctions of various members of the truss illustrated.

FIG. 7 is an architectural type drawing which lays out the various members of the truss as attached to the two columns. FIGS. 8 through 14 illustrate in close-up detail the type of junction used at the particular point on the truss denoted. Thus FIG. 10 shows the junction of the truss to a flanged column in the manner described infra. Reference is also made to FIG. 2 which spells out these details to a greater degree.

There is significant cost savings in material, shop fabrication time and erection time available from the use of the special moment truss frame of this invention. This can be seen from a viewing of the following table.

| PROJECT | SQUARE FT. | TIME SAVED | $$$ SAVED | COMMENTS |
|---|---|---|---|---|
| Gateway Oaks | 84,000 | 2 months of building | $200,000 | Customer pleased |
| Johnson Ranch | 44,000 | 1 month | $50,000 | Same |
| Roseville Center | 120,000 | 2 months | $200,000 | Same |
| Sierra Point | 120,000 | +/−30% | $200,000 | Other $$$ saving too |
| Glendale | 80,000 | 3 months | $200,000 | C.P. |
| Carlsbad | 60,000 | 2 months | $50,000 | C.P. |
| Anaheim | 130,000 | 3 months | $400,000 | C.P. |

In this table all dollar amounts are rounded off and time saved refers to total construction time reduction when compared to same building being built using conventional truss erection techniques. It is to be noted that Glendale, Carlsbad and the Anaheim projects are all located in Zone 4 seismic areas in the state of California. Zone 4 seismic areas are those geographical areas most susceptible to earthquakes.

Cost savings achievable using the special moment truss frame of this invention (SMTF) are found in the areas of materials and shop fabrication, and erection in both time and money. On the material side, it is a documented fact that an open web steel joist typically weighs about 20% less than a wide flange beam capable of carrying the same gravity loads. In addition to the weight savings is the fact that fabrication costs for open web framing are about 20% less than fabrication cost of wide flange beams.

The combination of less weight per square foot of building area and less cost per pound to produce equals about a 30% savings overall on the material, when the SMTF of this invention is utilized as opposed to the prior art conventional wide flange framing technique. Where 100 tons of wide flange framing would normally be used on a building site, only 80 tons of open web framing featuring the SMTF on this invention.

Results in a cost savings of $42,000.

Fabrication time is cut in half versus conventional wide flange frames due to the fact that normally, there is a split of responsibility between the steel fabricator who just provides the columns and the joist manufacturer who fabricates all the horizontal framing. Since the SMTF is made by the joist manufacturer, fabrication durations are measured in days rather than weeks.

Erection time savings can vary based on quantity and size frames along with inspection requirements. The minimum savings should be 20% with a potential reduction of as much as 70% if the inspection methodology requires ultrasonic testing of each pass of a wide flange moment connection. On a standard commercial office building of approximately 100,000 square feet there would be at least a two week reduction in the erection schedule, by avoidance of this inspection period.

As a result of the Northridge Earthquake, new codes have been implemented by U.B.C. that require conventional moment frames to have additional requirements such as doubler plates added at all flange-to-column connections.

Requirements of this nature substantially increase the quantity of weld passes required to complete the full penetration weld. On some projects such as hospitals or municipal buildings, inspection procedures require cool down, ultrasonic testing and preheat between every pass, requiring days to complete one connection.

The SMTF connection as discussed above, requires only a single pass fillet weld without preheat or ultrasonic testing reducing the labor costs as much as 90%. This is achieved by moving the inelastic deformation to a special link element at the midspan of the truss.

The combination of material, shop fabrication savings and erection savings relates to a cost reduction of a significant $5.00 per square foot, when the savings to be had are calculated on such a basis.

Savings can also be had way back at the design stage of the building in some instances, thus, if the drawings are prepared in conjunction with the development of the contract documents this can save on the average of four to six week sin the overall schedule of construction.

In conclusion is seen that I have devised a new truss which resists both vertical and lateral shear, and which truss's ultimate configuration is related to the columns with which it is employed in order to carry or bear both types of load within predefined drift limits.

Since certain changes may be made in the above described apparatus without departing from the scope of the invention herein involved, it is intended that all matter contained in the above description and shown in the accompanying drawings shall be interpreted as illustrative and not in a limiting sense.

I claim:

1. A truss center portion comprising:

a. a series of X-shaped bars, each X-shaped bar having a front member and each having a rear member, said series being planarly aligned;

b. corner gussets;

c. and two pairs of opposed top and bottom C-channels, wherein the series of X-shaped bars are connected to the corner gussets, which gussets are disposed between the opposed spaced top and bottom C-channel members, and each member of the X-shaped bar is a continuous member.

2. In the truss of claim 1 wherein one bar of a pair of X-shaped bars is connected to the other bar of a particular pair of X-shaped bars by a connector plate.

3. In the truss of claim 1 wherein the members of the X-shaped bars are square bars, and they are welded to the gussets.

4. In the truss center portion of claim 1 wherein vertical members are interposed between each successive unit of the series of X-shaped bars and at each terminal of said center portion, and said vertical members are of a different construction from the X-shaped members.

5. In the truss center portion of claim 1 wherein each gusset has an obverse face and a reverse face, and wherein a first end of one member of an X-shaped bar is connected to the obverse face of a gusset, and a first end of one member of the next adjacent X-shaped bar is connected to the same gusset.

6. In the truss center portion of claim 5 wherein a first end of a front member of an X-shaped bar is connected to the obverse face of a gusset, and a first end of the rear member of the next adjacent X-shaped bar is connected to the same gusset.

7. A new truss adapted to resist both vertical and lateral sheer during seismic events, which truss comprises three portions, a center portion and two outer portions;

a. said center portion being adapted to achieve a plastic state during a seismic event, wherein the center portion comprises a series of X-shaped bars, each member of each X-shaped bar being a continuous member having two ends, each end of each member of the X-shaped bars being coupled to a corner gusset; and b. two pairs of opposed top and bottom C-channels, wherein the gussets attached to each end of each X-shaped bar is disposed between the opposed spaced top and bottom C-channels.

8. In the truss of claim 7 wherein the corner gussets are welded to both the X-shaped bars and to the upper and lower opposed C-channels.

9. In the truss of claim 7 wherein vertical members are interposed between, each successive unit of the series of X-shaped bars and said vertical members are of a different construction from the X-shaped members.

10. In the truss of claim 7 wherein one bar of a pair of X-shaped bars is connected to the other bar of said pair of X-shaped bars by a connector plate.

11. In the combination of claim 10 wherein one bar of a pair of X-shaped bars is connected to the other bar of said pair of X-shaped bars by a connector plate.

12. In the combination of claim 11 wherein the connector plate is interposed between the two members of the X-shaped bar at about the midpoint of the X-shaped bar.

13. In the truss of claim 10 wherein the connector plate is interposed between the two members of the X-shaped bars at about the midpoint of the X-shaped bar.

14. In the truss of claim 7 wherein the members of the X-shaped bars are each square cross-section bars, and said bars are welded to the gussets.

15. In the truss of claim 7 wherein both members of the X-shaped bars are of a concentric cross-section along their entire continuous length.

16. In combination a pair of spaced wide columns having a truss disposed between the two columns, which truss comprises two outer portions with a center portion there between, wherein said center portion comprises a series of X-shaped bars having two members, each X-shaped bar member being a continuous member disposed one offset to the other;

corner gussets coupled to each end of each X-shaped bar member; and two pairs of opposed top and bottom C-channels wherein the corner gussets attached to each end of the X-shaped bars are disposed in said opposed C-channels.

* * * * *